United States Patent [19]

Zimmer et al.

[11] Patent Number: 4,671,175

[45] Date of Patent: Jun. 9, 1987

[54] DAMPENING SYSTEM FOR OFFSET PRINTING PRESS

[75] Inventors: Heinrich Zimmer, Rossdorf; Fritz May, Darmstadt-Eberstadt, both of Fed. Rep. of Germany

[73] Assignee: Maschinenfabrik Goebel GmbH, Darmstadt, Fed. Rep. of Germany

[21] Appl. No.: 878,239

[22] Filed: Jun. 25, 1986

[30] Foreign Application Priority Data

Jul. 23, 1985 [DE] Fed. Rep. of Germany ..... 3526236

[51] Int. Cl.[4] ..... B41F 7/30; B41F 7/36; B41F 7/26

[52] U.S. Cl. ..... 101/148; 101/349

[58] Field of Search ..... 101/148, 147, 349, 350–352, 101/207–210; 118/258, 259

[56] References Cited

U.S. PATENT DOCUMENTS

| | | | |
|---|---|---|---|
| 3,168,037 | 2/1965 | Dahlgren . | |
| 3,259,062 | 7/1966 | Dahlgren | 101/148 X |
| 3,508,489 | 4/1970 | Norton | 101/148 |
| 3,673,959 | 7/1972 | Jezwit et al. | 101/148 |
| 3,991,674 | 11/1976 | Petri | 101/148 |

FOREIGN PATENT DOCUMENTS

| | | |
|---|---|---|
| 0141217 | 9/1984 | European Pat. Off. . |
| 2439999 | 12/1976 | Fed. Rep. of Germany . |

*Primary Examiner*—J. Reed Fisher

*Attorney, Agent, or Firm*—Watson, Cole, Grindle & Watson

[57] ABSTRACT

A dampening system for an offset printing press combines a centrifugal plate wetting agent sprayer and roller dampening to effect a suitable ink and wetting agent balance.

6 Claims, 2 Drawing Figures

DAMPENING SYSTEM FOR OFFSET PRINTING PRESS

BACKGROUND OF THE INVENTION

This invention relates generally to a fluid dampening system, particularly for an offset printing press having at least one rotatable sprayer for spraying dampening fluid onto the first of a succession of dampening fluid transfer rollers.

A fluid dampening system having such a rotatable sprayer is disclosed in West German Pat. No. 2,439,999. Such a dampening system is employed for a rotary printing press, particularly a rotary offset printing press, for applying a wetting agent onto the printing plate of a print cylinder having a printing area and a non-printing area, the former being ink receptive and the latter being hydrophilic or moisture receptive. The apparatus according to the German patent has a plurality of such rotatable sprayers for spraying dampening fluid onto the surface of a roller included in the dampening system. Such roller transfers the dampening fluid to the printing plate for applying a film of moistening fluid to its surface which is retained by the hydrophilic area.

In order to assure that the dampening fluid is uniformly distributed onto the roller being sprayed, the spray issues through apertures located in confronting plates to meter the application of the dampening fluid to the roller, to thereby effect a relatively uniform application of the dampening fluid. Such uniformity is required if the printing plate is to be covered with a homogeneous film of the dampening fluid in the non-printing areas.

However, it has been shown that with the use of only such apertures it is not possible to apply the film of dampening fluid sufficiently uniformly and continuously to the printing plate as required for a given printing operation.

Also, a fluid dampening system employing rollers for applying a uniform film of the dampening fluid is disclosed in U.S. Pat. No. 3,168,037. Such a film dampening system, however, requires a relatively large number of rollers for applying the wetting agent sufficiently uniformly metered onto the printing plate.

Another fluid dampening system is disclosed in European Pat. No. 0,141,217 as having several fluid transfer rollers each with an elastic outer surface. However, such rollers do not simultaneously function as ink transfer rollers, such that it is difficult to achieve a suitable balance between printing ink and wetting agent in a short period of time.

SUMMARY OF THE INVENTION

It is therefore an object of the invention to provide an improved fluid dampening system for an offset printing press, in which at least one centrifugal sprayer is provided for spraying dampening fluid onto a first of several dampening fluid transfer rollers, such that at a relatively low cost and in a relatively short period of time an equilibrium of printing ink and wetting agent, which is suitable for printing, can be transferred to the printing plate even if one of the two ink and wetting agent components is changed for a short period of time. This general objective is achieved by the provision of a succession of at least four dampening fluid transfer rollers, one of which simultaneously serves as an ink transfer roller. The second of these rollers in the direction of transfer of the wetting agent has an elastic surface, and only the first, second and third rollers respectively have intermeshed gearing. The gearing between the first and second rollers are differently sized for effecting a lower rate of rotation of the first roller relative to that of the second roller and thereby a consequent slippage between the first and second rollers, such that the dampening fluid is evenly distributed on the surfaces of the rollers.

Another feature of the invention is that the first roller is capable of being adjusted relative to the second roller, and both the first and second rollers together are capable of being adjusted relative to the third roller. This third roller can be a distributor roller having a surface of polyamide or similar material. In addition to these adjustment capabilities, it is possible to separate or turn off as necessary at least one of the rollers with respect to any of the other rollers.

With the present invention it is possible to combine the advantages of the centrifugal sprayer dampening system with that of the roller dampening system to effect a dampening system that is relatively simple to construct and is capable of metering the dampening fluid such that it is uniformly distributed as a film on the printing plate and, when several centrifugal sprayers are employed, facilitates changing the thickness of the wetting agent film from zone to zone.

Other objects, advantages and novel features of the invention will become more apparent from the following detailed description of the invention when taken in conjunction with the accompanying drawing.

DETAILED DESCRIPTION OF THE INVENTION

Figure 1:
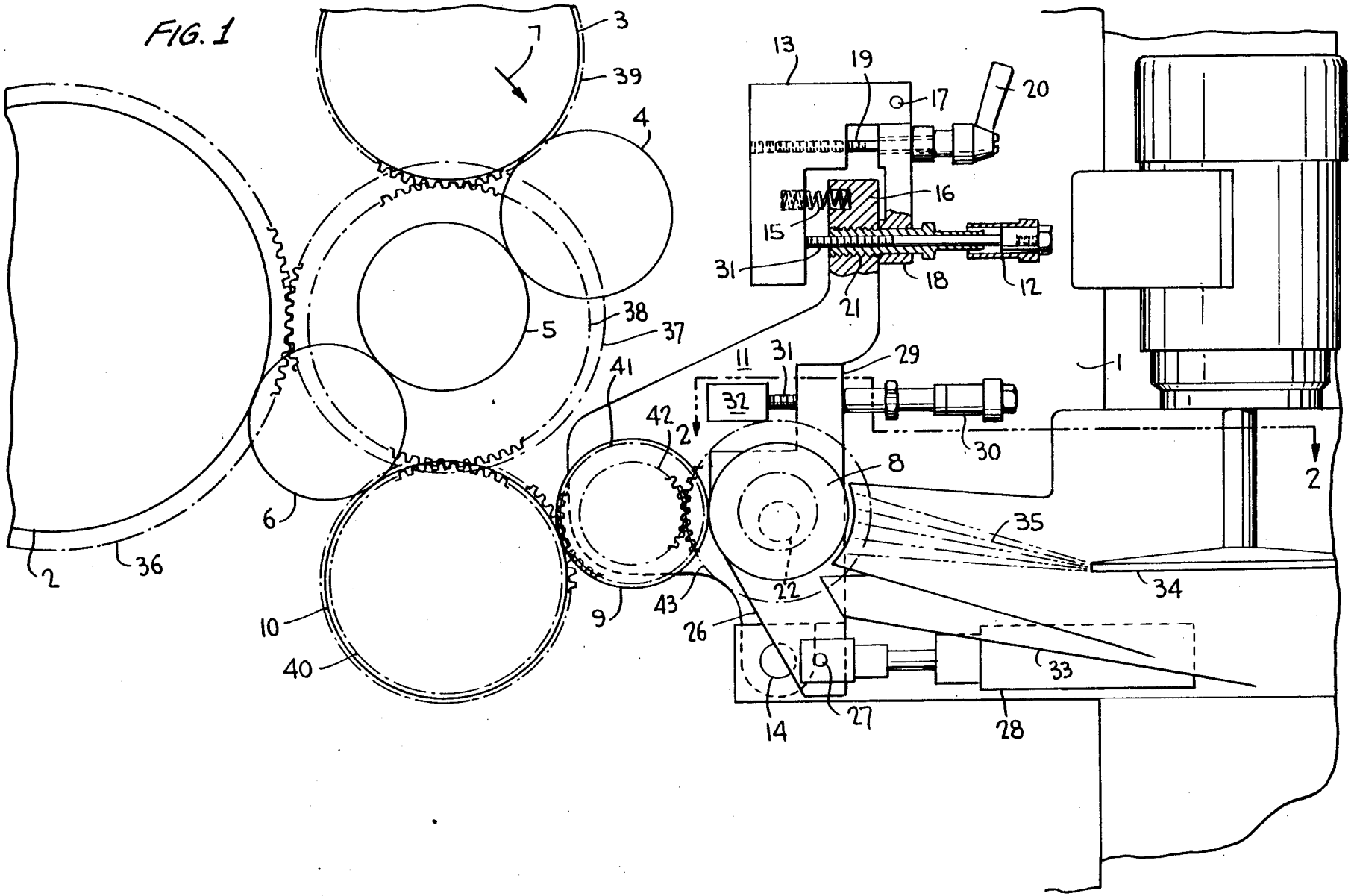
FIG. 1 schematically illustrates, in side elevation, the fluid dampening system according to the invention, and is taken substantially along the line 1—1 of FIG. 2.

Turning now to the drawings wherein like reference characters refer to like and corresponding parts throughout the several views, opposed side walls of a frame 1 of an offset rotary printing press, capable of printing webs of indeterminate length, has a plate cylinder 2 journalled on the frame in some suitable manner, and being driven in a typical known manner. At least one printing plate is mounted in the usual manner on the surface of the plate cylinder. Printing is normally carried out with blanket and impression cylinders (not shown).

The printing plate typically has a printing area and a non-printing area, the former being ink receptive and the latter being hydrophilic or moisture receptive.

Ink transfer rollers 3, 4, 5 and 6 are journalled on the frame for transferring ink to the plate cylinder in the direction of arrow 7 from an ink supply (not shown). Roller 6 forms not only a part of the ink transfer system but also a component of the dampening system which includes dampening fluid transfer rollers 8, 9 and 10, in succession, in the direction of transfer of the wetting agent.

Figure 2:
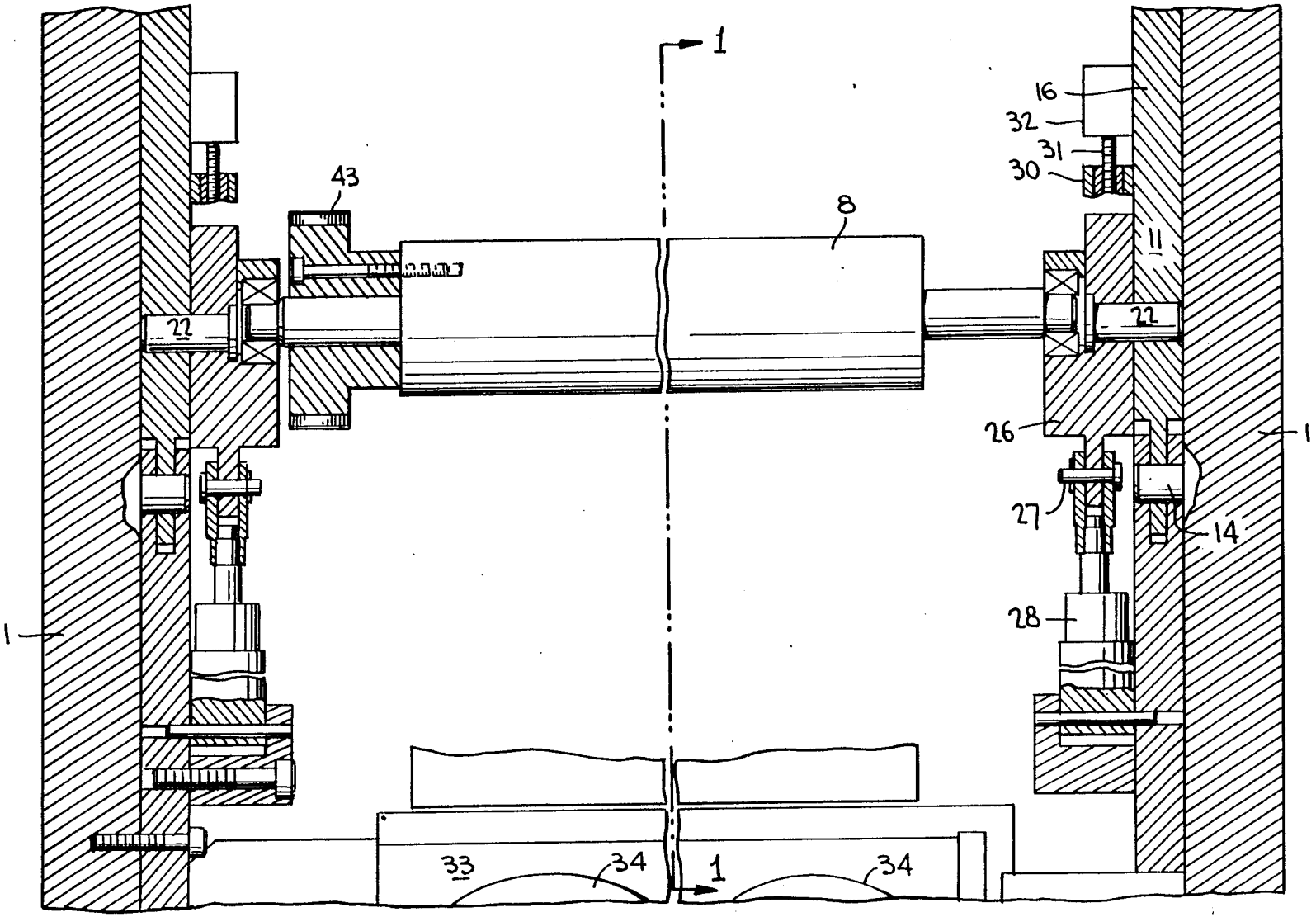
FIG. 2 is a plan view taken substantially along the line 2—2 of FIG. 1.

Roller 9 of the dampening system is rotatably journalled mounted on a pivot arm 11 mounted on the frame for pivotal movement on a pin 14, and is capable of being pivoted by operation of a set screw 12 relative to a stop 13, the latter being mounted on the frame but not shown in FIG. 2 for the sake of clarity. A compression spring 15 resiliently urges an arm 16 of pivot arm 11 clockwise (when viewed in FIG. 1) away from stop 13 which is mounted on the machine frame.

A flap 18 is pivotally mounted at 17 on stop 13. A threaded fastener 19 engages the threads of internally threaded axial bores located in stop 13 and in flap 18, and a hand lever 20 is affixed to the fastener. The position of the flap relative to the stop can therefore be adjusted by operation of the hand lever.

Set screw 12 engages the threads of an internally threaded bore 21 of arm 16. In such manner, the position of arm 16 relative to stop 13 can be controlled by operation of hand lever 20, set screw 19, flap 18 and the relative position of set screw 12. Thus, the size of the gap between the surfaces of rollers 9 and 10, i.e. the contact between rollers 9 and 10 can set as arm 11, which carries roller 9, is pivoted toward and away from roller 10 about pivot 14.

Roller 8 is journalled in an eccentric sheave 22 of an arm 26 which is pivotally mounted on arm 16. The sheave axis is offset from such pivot axis by a suitable distance x shown in FIG. 2.

Arm 26 is pivotally connected as at 27 to the piston of a pressure medium cylinder 28 pivotally mounted on the press frame. Arm 26 has a set arm 29 with an internally threaded bore engaged by a set screw 30 which is similar to set screw 12, and both having a set pin 31. Pin 31 of set screw 30 bears against a stop 32 affixed to lever 11, and set pin 31 of set screw 12 bears against stop 13 which is affixed to the press frame.

Thus, upon operation of cylinder 28, the eccentric sheave is rotated about the pivot axis of arm 26 to thereby adjust the gap between rollers 8 and 9. The size of the nip between rollers 8 and 9 is adjusted by operation of set screw 30.

As shown in FIG. 2, the aforedescribed assemblies for effecting adjustment between rollers 8 and 9, and between rollers 9 and 10, are located at both side walls of the press frame.

A dampening fluid or wetting agent assembly 33 is mounted on frame 1, and includes a centrifugal plate sprayer 34. Several of such plate sprayers can be arranged one behind the other, as viewed in FIG. 1, so as to be distributed over the working width of the press. The wetting agent which is ultimately transferred to the printing plate is initially fed to the sprayer in a known manner, and issues as a conical spray 35 upon rotation of the plate or plates 34. This spray cone is focused on first dampening roller 8 such that the wetting agent is transferred to the printing plate on print cylinder 2 via dampening rollers 9, 10 and 6.

Print cylinder 2 has a concentric toothed gear 36 rotatable therewith and intermeshed with a toothed gear 37 mounted on ink transfer roller 5. Another concentric gear 38 on roller 5 intermeshes with a concentric gear 39 on roller 3 and with a concentric gear 40 on roller 10. Gear 40 intermeshes with a concentric gear 41 on roller 9 which rotates together therewith. Another concentric gear 42 on roller 9 intermeshes with a concentric gear 43 on roller 8 which, as with all the concentric gears, respectively rotates with the roller to which it is attached. The effective diameter of gear 43 is larger than the outer diameter of the dampening roller 8, and the effective diameter of gear 42 is smaller than the outer diameter of dampening roller 9. This results in a conversion of, for example, a range of 1:2, such that dampening roller 8 rotates slower, i.e. half as fast, than second dampening roller 9. In such manner, slippage is effected between rollers 8 and 9 such that the droplets of the wetting agent sprayed onto the surface of roller 8 are distributed.

Third dampening roller 10 is connected to a so-called traversing drive (not shown) such that, during operation of the press, roller 10 rotates not only about its own axis but also moves axially back and forth along such axis during its rotation. In such manner the wetting agent transferred to the roll surface of roller 10 via plate 34 and rollers 8 and 9, is further equalized so that a uniform film of wetting agent is transferred to the fourth dampening roller 6 (applicator roller) and thus to print cylinder 2.

The surface of dampening roller 8 may be of a hard hydrophilic material, such as a metal, in particular chrome. The surface of dampening roller 9 is of elastomeric material, such as a rubber with a Shore-A hardness of 30. The surface of dampening roller 10 is of a semi-hard, ink-wettable plastic, such as for example a polyamide, sold under the trade name Rilsan, a registered trademark of ATO-Chimie of the Federal Republic of Germany. The surface of roller 6 may be of an elastomeric material, such as a rubber with a Shore-A hardness of 30.

Flap 18 can be loosened upon operation of hand lever 20 so that arm 16 and its lever 11 can be pivoted about the axis of pin 14 to the right, when viewed in FIG. 1 under the resiliency of spring 15. Thus, dampening rollers 9 and 10 can be separated from one another so that no wetting agent is transferred from roller 9 to roller 10. Thus, the surfaces of rollers 9 and 10, made of resilient material, will not be pressed against one another for an unduly long period of time during long breaks in operation of the press, and thus, eventially deformed. Moreover, the separation permits the dampening system to be started directly before the printing operation without immediately starting the moistening process. Consequently, rollers 8 and 9 can be pre-moistened before the wetting agent is transferred to rollers 10 and 6 and thus to the printing plate. Therefore, prior to the commencement of the printing operation and following the start of the printing press, in particular following the start of the ink transfer, the ink is transferred in succession from rollers 3, 4, 5 and 6, and roller 10 of the dampening system in the direction of arrow 7. However, no ink will be transferred to rollers 8 and 9, since they are completely covered with the wetting agent.

Following several revolutions of the rollers, lever 11 may be pivoted counterclockwise (when viewed in FIG. 1) upon operation of hand lever 20, so that the surfaces of dampening rollers 9 and 10 are brought into contact with one another, provided stop 13 and the setting of set pin 31 and set screws 12 and 13 are appropriately adjusted. Set screws 12 and 30 can be adjusted in accordance with empirical values, or their setting can be predetermined. Since eccentric sheave 22 and thus the mounting position of roller 8 of the dampening system are mounted on lever 11, both rollers 8 and 9 of the dampening system can be adjusted together relative to third roller 10. However, operation of hand lever 20 and the resilient urgency of spring 15 permits separation of at least one of the rollers from the others, i.e. rollers 8 and 9 from rollers 10 and 6. This separation may be carried out for longer pauses during the printing operation.

Otherwise, hand lever 20 need not be manually operated but rather the piston of pressure medium cylinder 28. In such manner rollers 8 and 9 are separated from one another via eccentric sheave 22, such that rollers 9, 10 and 6 remain in contact with one another. Thus, during the intake process only roller 8 is pre-moistened, and rollers 9, 10 and 6 are coated with an ink film. Even if rollers 8 and 9 are separated, the balance between wetting agent and printing ink, which is required for offset printing, for example, after the offset printing press has been started or after the quantity of the inking or wetting agent to be applied has been changed, can be obtained in a very short period of time between rollers 9 and 10.

In accordance with the present arrangement, in particular the specific position of the adjustable roller gap, the succession of materials of the various surfaces of the rollers of the dampening system that are driven in the direction of the flow of the wetting agent and the selected position of the roller or rollers for traversing, effects a dampening system which reacts quickly to changes in one or both wetting agent and ink components of the mixture and to variations in the wetting agent/printing ink mixture. Moreover, the dampening system is relatively simple to construct and produces improved printing results.

Sequencing can be included for displacing the piston of pressure medium cylinder 28. With such sequencing applicator roller 6 for the printing ink and the wetting agent can be turned on and off. Thus, operation of the press is made easier, in particular when prior to the start of printing there is a need for printing ink and wetting agent balance.

The diameters of rollers 6, 8 and 9 are essentially the same. The diameter of dampening roller 10 is about twice the diameter of rollers 6, 8 and 9.

Obviously, many other modifications and variations of the present invention are made possible in the light of the above teachings. It is therefore to be understood that within the scope of the appended claims the invention may be practiced otherwise than as specifically described.

What is claimed is:

1. A dampening system for an offset printing press, comprising, in combination, a succession of first, second, third and fourth dampening fluid transfer rollers, a rotatable sprayer for spraying dampening fluid on to the surface of said first roller, said fourth roller also comprising being an ink transfer roller, said second roller having surface of elastomeric material, only said first, second and third rollers respectively having intermeshed gearing, the gearing between said first and second rollers being differently sized for effecting a lower rate of rotation of said first roller relative to that of said second roller and thereby a consequent slippage between said first and second rollers, whereby the dampening fluid is distributed on said surfaces of said rollers.

2. The system according to claim 1, wherein means are provided for adjusting said first roller toward and away from said second roller.

3. The system according to claim 1, wherein means are provided for adjusting said first and second rollers together toward and away from said third roller.

4. The system according to claim 1, wherein said third roller comprises a dampening fluid distributor roller.

5. The system according to claim 1, wherein said third roller has a surface of polyamide material.

6. The system according to claim 1, wherein means are provided for separating one of said rollers from another of said rollers.

* * * * *